US011247218B1

(12) United States Patent
Hall

(10) Patent No.: US 11,247,218 B1
(45) Date of Patent: Feb. 15, 2022

(54) INTERNAL POWDER COATING NOZZLE AND METHOD OF USE

(71) Applicant: Robert Hall, Weatherford, TX (US)

(72) Inventor: Robert Hall, Weatherford, TX (US)

( * ) Notice: Subject to any disclaimer, the term of this patent is extended or adjusted under 35 U.S.C. 154(b) by 33 days.

(21) Appl. No.: 16/516,710

(22) Filed: Jul. 19, 2019

Related U.S. Application Data

(60) Provisional application No. 62/700,631, filed on Jul. 19, 2018.

(51) Int. Cl.
*B05B 1/20* (2006.01)
*B05D 1/12* (2006.01)
*B05D 7/22* (2006.01)

(52) U.S. Cl.
CPC ..... *B05B 1/20* (2013.01); *B05D 1/12* (2013.01); *B05D 7/225* (2013.01)

(58) Field of Classification Search
CPC ..... B05B 1/20; B05D 1/12; B05D 7/225
USPC ..... 118/306
See application file for complete search history.

(56) References Cited

U.S. PATENT DOCUMENTS 2,090,851 A * 8/1937 Perkins ..... B28B 19/0023 118/105
3,291,631 A * 12/1966 Smith ..... B05B 7/1486 427/195
4,414,918 A * 11/1983 Holland ..... B05B 13/06 118/306

* cited by examiner

*Primary Examiner* — Chee-Chong Lee
(74) *Attorney, Agent, or Firm* — Leavitt Eldredge Law Firm

(57) ABSTRACT

An internal pipe powder coating system includes a nozzle having an attachment device to removably attach to a chamber; the nozzle having holes extending through a thickness of the body; a powder coating machine engaged with the chamber to deliver powder coating to the nozzle; the nozzle sprays the powder coating to an inside of a pipe.

2 Claims, 5 Drawing Sheets

INTERNAL POWDER COATING NOZZLE AND METHOD OF USE

BACKGROUND

1. Field of the Invention

The present invention relates generally to systems and method of powder coating an inside of a pipe, and more specifically, to an internal powder coating nozzle and method of powder coating with the same.

2. Description of Related Art

Methods of powder coating the inside of a pipe are common, particularly within industries such as oilfield machine production. Powder coating the inside of a pipe is an effective means to prolong the life of the pipe. Flowchart 101 in FIG. 1, depicts a conventional method in which a forward or spinning nozzle is attached to a chamber and inserted into a pipe, wherein a powder coating machine is activated and the nozzle is pulled through the pipe to coat the inside of the pipe, as shown with boxes 103, 105, 107, 109.

One of the problems commonly associated with method 101 is ineffective coating. For example, it is conventional for forward or spinning nozzles to be used, thereby making the coverage of the inside of the pipe non-uniform.

Accordingly, although great strides have been made in the area of systems and methods for powder coating, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
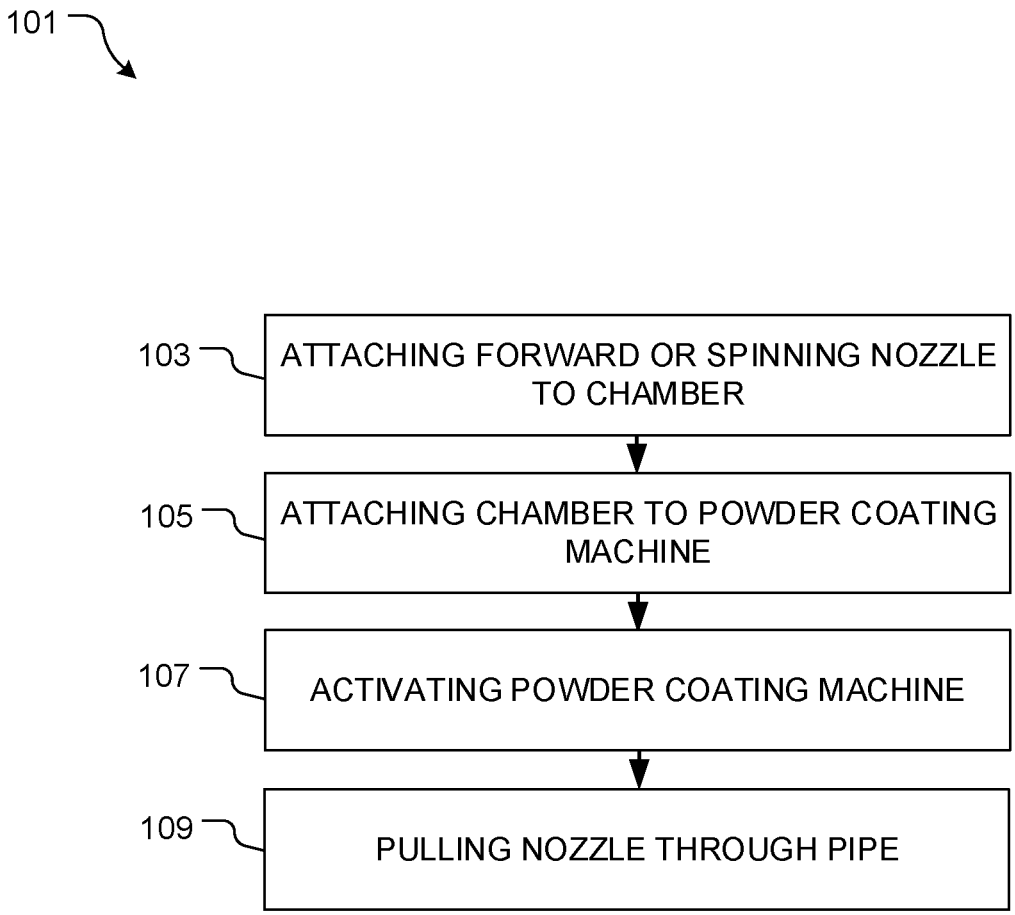
FIG. 1 (Prior Art)
FIG. 1 is a flowchart of a conventional method of powder coating.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional powder coating systems. Specifically, the present invention provides a convenient nozzle configured to provide for a more uniform coverage of the inside of the pipe. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
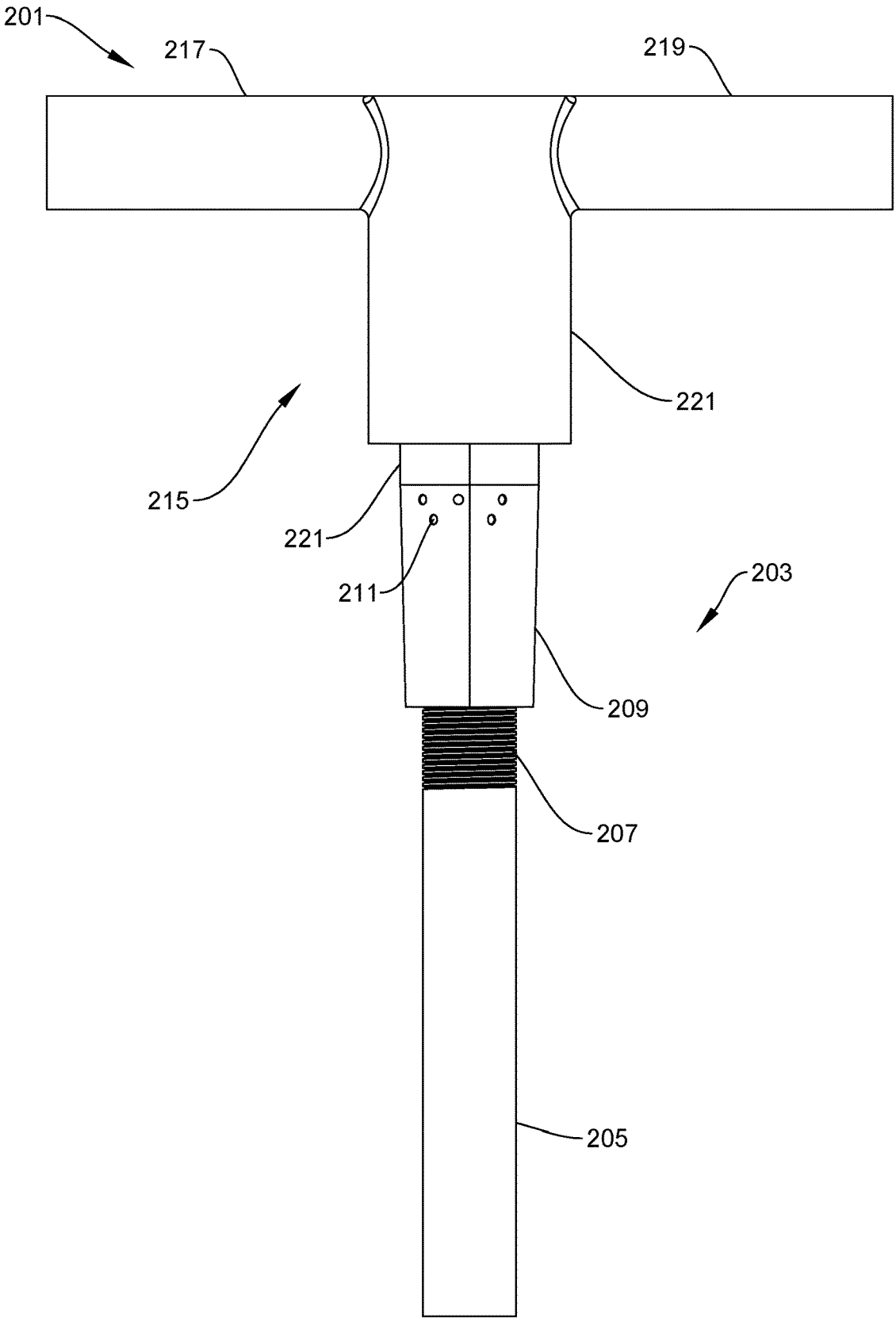
FIG. 2 is a side view of a powder coating system in accordance with a preferred embodiment of the present application.
Figure 3:
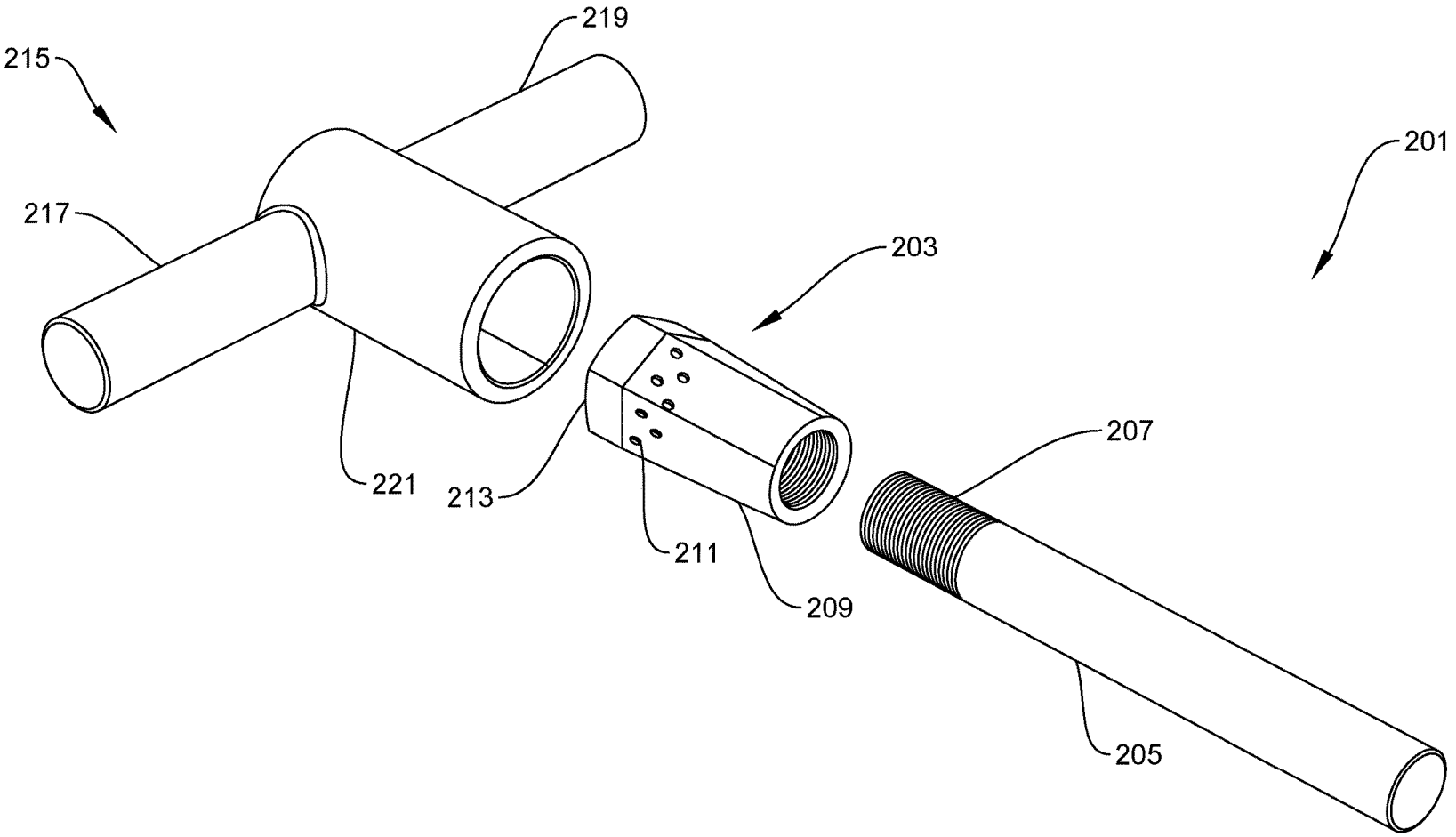
FIG. 3 is an exploded view of the system of FIG. 2.

Referring now to the drawings wherein like reference characters identify corresponding or similar elements throughout the several views, FIGS. 2 and 3 depict side views of a powder coating system 201 in accordance with a preferred embodiment of the present application. It will be appreciated that system 201 overcomes one or more of the above-listed problems commonly associated with conventional powder coating systems.

In the contemplated embodiment, system 201 includes a nozzle 203 configured to attach to a chamber 205 via an attachment means 207, such as a threaded connection, wherein powder coating is directed from a powder coating machine (not shown), through chamber 205 to nozzle 203. In the preferred embodiment, nozzle 203 includes a body 209 having a plurality of holes 211 extending through a thickness of body 209. It should be appreciated that end 213 is blocked, thereby forcing the powder coating through holes 211.

In some embodiments, a centering device 215 having one or more arms 217, 219 extending from a center 221 is attached to end 213 to ensure that nozzle 203 remains centered in a pipe during use. Although shown with two arms 217, 219, the centering device could include additional arms.

Figure 4:
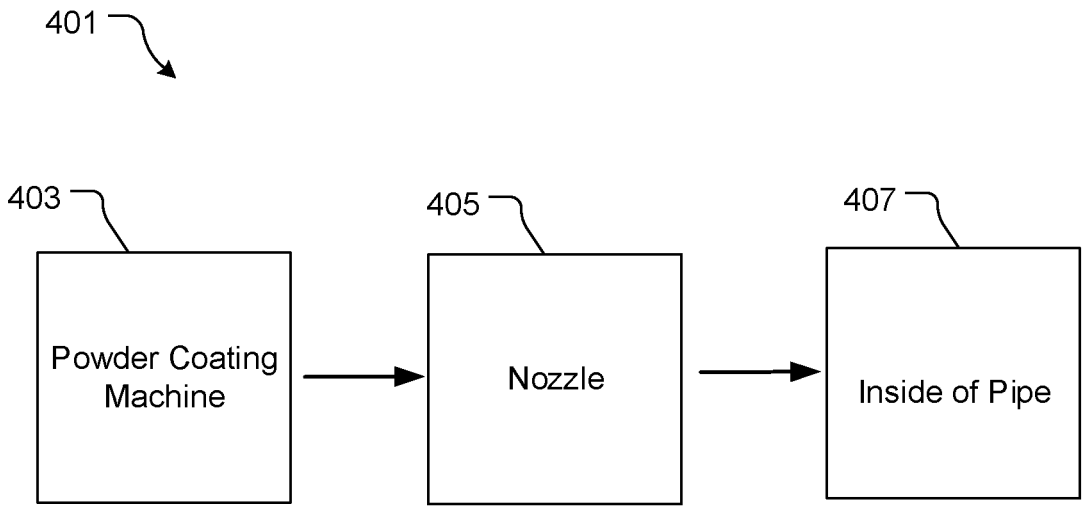
FIG. 4 is a schematic of the system of FIG. 2.

In FIG. 4, a schematic depicts system 201, wherein a powder coating machine 403 is in communication with the nozzle 405, and the nozzle 405 is configured to spray the powder coating to coat the inside of the pipe 407.

It should be appreciated that one of the unique features believed characteristic of the present application is nozzle 203 having a plurality of holes configured to spray the powder coating outwardly in a uniform fashion, thereby ensuring complete and consistent coverage of the inside of the pipe.

Figure 5:
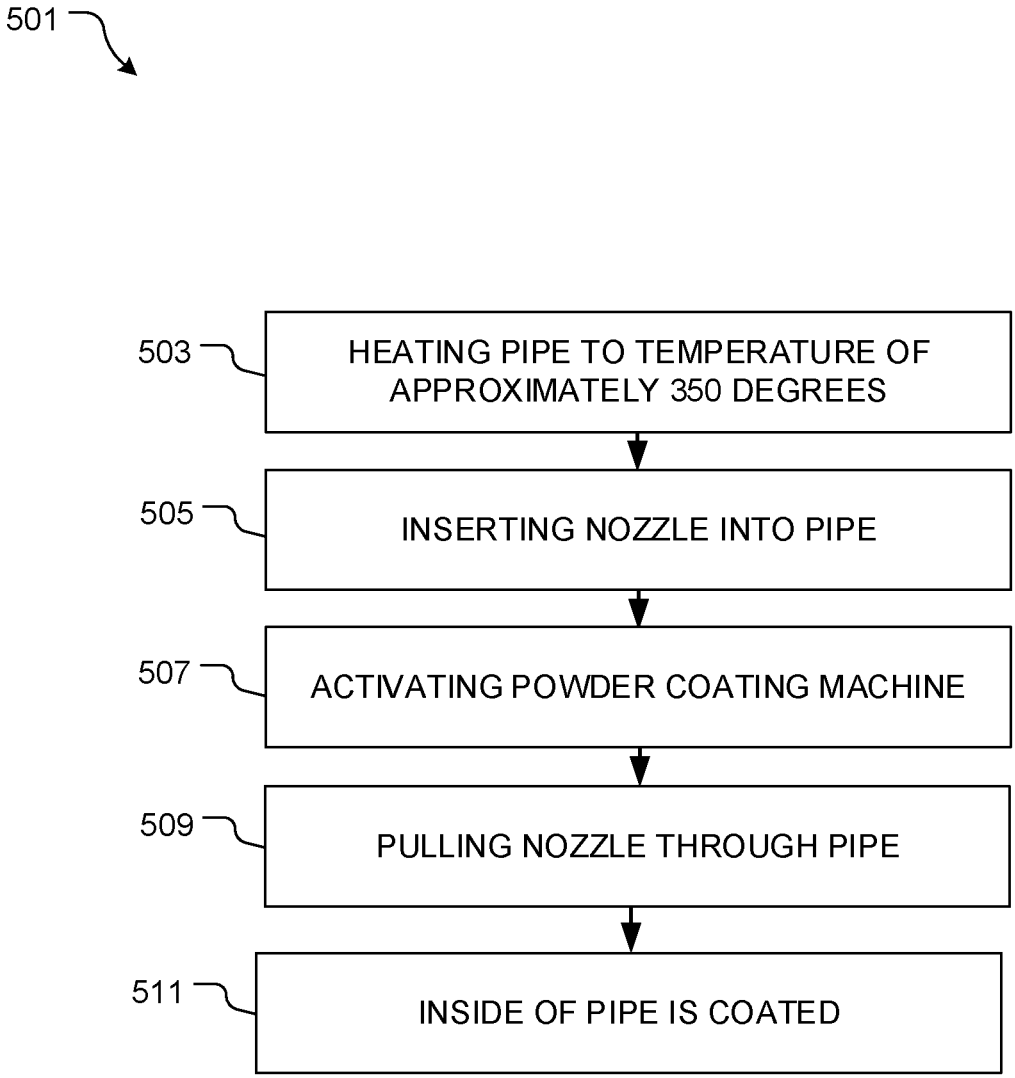
FIG. 5 is a flowchart of the method of use of the system of FIG. 2.

In FIG. 5, a flowchart 501 depicts the method of sue of system 201. During use, the pipe is heated to a temperature of approximately 350 degrees, as shown with box 503. The user then inserts the nozzle to the furthest end of the pipe, as shown with box 505. After the user activates the powder coating machine, the user pulls the nozzle through the pipe, thereby coating the inside of the pipe with powder coating, as shown with boxes 507, 509, 511.

It should be appreciated that the type of powder coating can vary, however, one contemplated embodiment is for use with fusion bonded epoxy. It should further be appreciated that the size and dimensions of the nozzle can vary, with one embodiment having a diameter of approximately 1.5 inches, and a length being anywhere from 1.5 inches to 6 inches long. The chamber herein described is a pipe-like structure, however, called a chamber throughout for clarity to distinguish from the pipe being coated.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An internal pipe powder coating system for a pipe having an inner surface, comprising:

an elongated chamber configured to channel powder coating material;

a centering device having a first arm and a second arm, the first arm and the second arm are configured to come into contact with the inner surface of the pipe, the centering device forms an opening, and has a length extending from a first end of the first arm and to a second end of the second arm, the length is equal to an inner diameter of the pipe such that the first end of the first arm and the second end of the second arm simultaneously engage with the inner surface of the pipe to keep the elongated chamber coaxially aligned with a center of the pipe;

a nozzle located in a center of the system between the first and second arms, the nozzle having an attachment device that removably attaches to the elongated chamber, the nozzle is positioned between the elongated chamber and the centering device, the nozzle is configured to fit within the opening of the centering device, the nozzle having:

a body; and a plurality of holes extending through a thickness of the body, the plurality of holes positioned below the centering device to emit powder coating material therefrom such that the powder coating material is emitted in the center of the pipe;

a powder coating machine engaged with the elongated chamber and configured to deliver powder coating material to the nozzle;

wherein the nozzle sprays the powder coating material to the inner surface of the pipe via the plurality of holes.

2. The system of claim 1, further comprising:

wherein the centering device is configured to engage with the nozzle and prevent contact between the nozzle and the inside of the pipe.

* * * * *